US007497565B2

(12) United States Patent
Kinoshita et al.

(10) Patent No.: US 7,497,565 B2
(45) Date of Patent: Mar. 3, 2009

(54) MEDIUM FEEDING DEVICE AND RECORDING APPARATUS OR LIQUID EJECTING APPARATUS INCORPORATING THE SAME

(75) Inventors: Masaaki Kinoshita, Nagano (JP); Junya Kato, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 443 days.

(21) Appl. No.: 11/185,014

(22) Filed: Jul. 20, 2005

(65) Prior Publication Data

US 2006/0017794 A1 Jan. 26, 2006

(30) Foreign Application Priority Data

Jul. 20, 2004 (JP) ..... 2004-211015
Feb. 4, 2005 (JP) ..... 2005-028478

(51) Int. Cl.
*B41J 2/01* (2006.01)

(52) U.S. Cl. ..... 347/101; 347/104; 271/9.03; 271/9.05; 271/9.08; 271/10.1; 271/121; 400/582; 400/629; 400/605; 399/309; 399/367

(58) Field of Classification Search ..... None
See application file for complete search history.

(56) References Cited

U.S. PATENT DOCUMENTS 4,025,066 A * 5/1977 Sue ..... 271/9.08
5,624,107 A * 4/1997 Deguchi et al. ..... 271/3.2
5,678,814 A * 10/1997 Yokoyama et al. ..... 271/9.05
5,951,180 A * 9/1999 Kawaura ..... 400/629
6,135,444 A * 10/2000 Padget ..... 271/121
6,158,909 A * 12/2000 McCue et al. ..... 400/582

FOREIGN PATENT DOCUMENTS

JP 2002-68535 A 3/2002

* cited by examiner

*Primary Examiner*—Luu Matthew
*Assistant Examiner*—John P Zimmermann
(74) *Attorney, Agent, or Firm*—Sughrue Mion, PLLC

(57) ABSTRACT

A medium feeding device is adapted to be attached to a recording apparatus to feed a recording medium thereto or adapted to be attached to a liquid ejecting apparatus to feed a target medium thereto A first tray is provided with a hopper adapted to support the recording medium or the target medium which is to be automatically fed to the recording apparatus or the liquid ejecting apparatus by a feeding roller. A second tray is arranged above the first tray and adapted to support the recording medium or the target medium which is to be manually fed to the recording apparatus or the liquid ejecting apparatus. The second tray includes a tray body and an extensible member which is retractably extended from the tray body toward the feeding roller.

13 Claims, 16 Drawing Sheets

MEDIUM FEEDING DEVICE AND RECORDING APPARATUS OR LIQUID EJECTING APPARATUS INCORPORATING THE SAME

BACKGROUND OF THE INVENTION

The present invention relates to a medium feeding device to be incorporated in a recording apparatus or a liquid ejecting apparatus to feed a recording medium or a target medium. More particularly, the present invention relates to a medium feeding device enabled to manually feed a recording medium or a target medium to the recording medium or the liquid ejecting apparatus.

There is an ink jet printer available as one of large-sized recording apparatuses enabled to print sheets of paper, whose size is a relatively large size, for example, from JIS (Japanese Industrial Standard) A4 size to JIS A2 size. Such a large-sized ink jet printer handles heavy paper. Thus, it is difficult for this ink jet printer to supply paper from the rear side thereof and eject paper at the front side thereof similarly to a small-sized ink jet printer. Consequently, this large-sized ink jet printer is adapted to supply and eject paper at the Font side thereof. That is, a sheet supply cassette, which is enabled to accommodate sheets of paper (one example of the recording medium or the target medium) to be automatically fed, and a sheet feeder/ejector including a cover portion of the sheet supply cassette which is enabled to stack thereon sheets of paper having been automatically ejected and is enabled to manually supply sheets of paper therefrom. The sheet feeder/ejector is disposed at the front of this ink jet printer.

When sheets of paper are automatically fed by this sheet feeder/ejector, plural sheets of paper are accommodated in a stacked state in the sheet supply cassette. Then, a leading edge of the accommodated sheet of paper is lifted by a hopper, and is caused to abut against a sheet feeding roller. Thus, the sheets of paper are sequentially friction-fed from the top sheet thereof while guided by a sheet edge guide. Meanwhile, when the sheets of paper are manually fed, for example, the trailing end portion of one sheet of paper is put on the cover portion. Then, the leading end portion of this sheet of paper is set to be superposed on the leading end portion of each of the sheets of paper accommodated in the sheet supply cassette. Subsequently, the leading edge of the manually-fed sheet of paper is lifted by the hopper together with the sheets of paper accommodated in the sheet supply cassette, and is caused to abut against the sheet feeding roller. Then, the sheets of paper are friction-fed while the leading end portions of the sheets of paper are guided by the sheet edge guide (see Japanese Patent Publication No. 2002-68535A).

In the aforementioned sheet feeder/ejector, in a case where the sheet of paper accommodated in the sheet supply cassette differs in kind of paper from that of paper put on the cover portion, adhesion sometimes occurs between these sheets of paper. In a case where such adhesion occurs, overlapped-sheet feeding easily occurs at the friction feed of a sheet of paper. This may preclude the subsequent conveyance and recording of a sheet of paper.

To solve this problem, it is advisable to form the cover portion of the sheet supply cassette in a size sufficient to put the whole of a sheet of paper, which is manually fed, on the cover portion. However, in the case of forming such a cover portion, there is the necessity for providing a space between the cover portion and the sheet edge guide to thereby prevent the cover portion from interfering with the sheet edge guide when the cover portion is lifted by the hopper. Thus, when the sheet of paper to be manually fed is set, an edge of the sheet of paper may enter the space and may be folded. This may preclude the manual feeding of the sheet of paper.

SUMMARY OF THE INVENTION

It is therefore an object of the invention to provide a medium feeding device enabled to prevent occurrence of failure at the manual feeding of a recording medium or a target medium to a recording apparatus or a liquid ejecting apparatus.

In order to achieve the above object, according to the invention, there is provided a medium feeding device, adapted to be attached to a recording apparatus to feed a recording medium thereto or adapted to be attached to a liquid ejecting apparatus to feed a target medium thereto, comprising:

- a feeding roller;
- a first tray, provided with a hopper adapted to support the recording medium or the target medium which is to be automatically fed to the recording apparatus or the liquid ejecting apparatus by the feeding roller; and
- a second tray, arranged above the first tray and adapted to support the recording medium or the target medium which is to be manually fed to the recording apparatus or the liquid ejecting apparatus, the second tray comprising a tray body and an extensible member which is retractably extended from the tray body toward the feeding roller.

With this configuration, when the medium is placed on the second tray, it will not come in direct contact with the medium placed in the first tray. Consequently, the medium to be manually fed and the medium to be automatically fed are prevented from being stuck to each other.

Preferably, the tray body adapted to contain the extensible member when the extensible member is retracted from the feeding roller. In this case, when the second tray is not used, the extensible member can be accommodated in the tray body in a compact manner.

Preferably, the hopper is operable to lift the tray body and the extensible member to bring the recording medium or the target medium placed thereon into contact with the feeding roller. In this case, there is no need for additionally providing a lifting mechanism for the second tray. Thus, the mechanism can be simplified. Also, space-saving can be achieved.

Preferably, the tray body is provided with a lever mechanism operable to extend or retract the extensible member. In this case, a user can easily perform operations of extending and retracting the extensible member.

Here, it is preferable that the lever mechanism includes a movable member which is placed in a lateral end portion of the tray body to guide a side edge of the recording medium or the target medium when the extensible member is extended, and is placed in such a position that an ingress of the recording medium or the target medium when the extensible member is retracted. In this case, the accuracy in manual feeding operation can be enhanced. Additionally, when the medium is automatically fed, it can be prevented from interfering with the medium to be manually fed.

It is also preferable that the lever mechanism includes a cam mechanism coupling the movable member and the extensible member. In this case, the configuration of the apparatus can be simplified.

Preferably, the medium feeding device further comprises a pair of guide members adapted to guide a leading end of the recording medium or the target medium supported by the extendible member. A gap is provided between a distal end of the extensible member and each of the guide members. The distal end of the extensible member is formed with a portion projecting into a space defined between the guide members. In this case, when the medium to be manually fed is placed on the extensible member, the leading end of the medium can be prevented from entering the gap provided between the extensible member and each of the guide members. Consequently, the manual feeding operation can surely be achieved.

According to the invention, there is also provided a recording apparatus comprising a recording head operable to record information on the recording medium fed by the above medium feeding device.

According to the invention, there is also provided a liquid ejecting apparatus comprising a liquid ejecting head operable to eject a liquid droplet toward the target medium fed by the above medium feeding device.

According to the invention, there is also provided a medium feeding device, adapted to be attached to a recording apparatus to feed a recording medium thereto or adapted to be attached to a liquid ejecting apparatus to feed a target medium thereto, comprising:

a feeding roller;

a first tray, provided with a hopper adapted to support the recording medium or the target medium which is to be automatically fed to the recording apparatus or the liquid ejecting apparatus by the feeding roller;

a second tray, arranged above the first tray and adapted to support the recording medium or the target medium which is to be manually fed to the recording apparatus or the liquid ejecting apparatus; and a pair of guide members adapted to guide a leading end of the recording medium or the target medium supported by the second tray, wherein:

a gap is provided between an end of the second tray opposing to the feeding roller and each of the guide members; and the end of the second tray is formed with a portion projecting into a space defined between the guide members.

With this configuration, when the medium to be manually fed is placed on the second tray, the leading end of the medium can be prevented from entering the gap provided between the second tray and each of the guide members. Consequently, the manual feeding operation can surely be achieved.

According to the invention, there is also provided a recording apparatus comprising a recording head operable to record information on the recording medium fed by the above medium feeding device.

According to the invention, there is also provided a liquid ejecting apparatus comprising a liquid ejecting head operable to eject a liquid droplet toward the target medium fed by the above medium feeding device.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Figure 1:
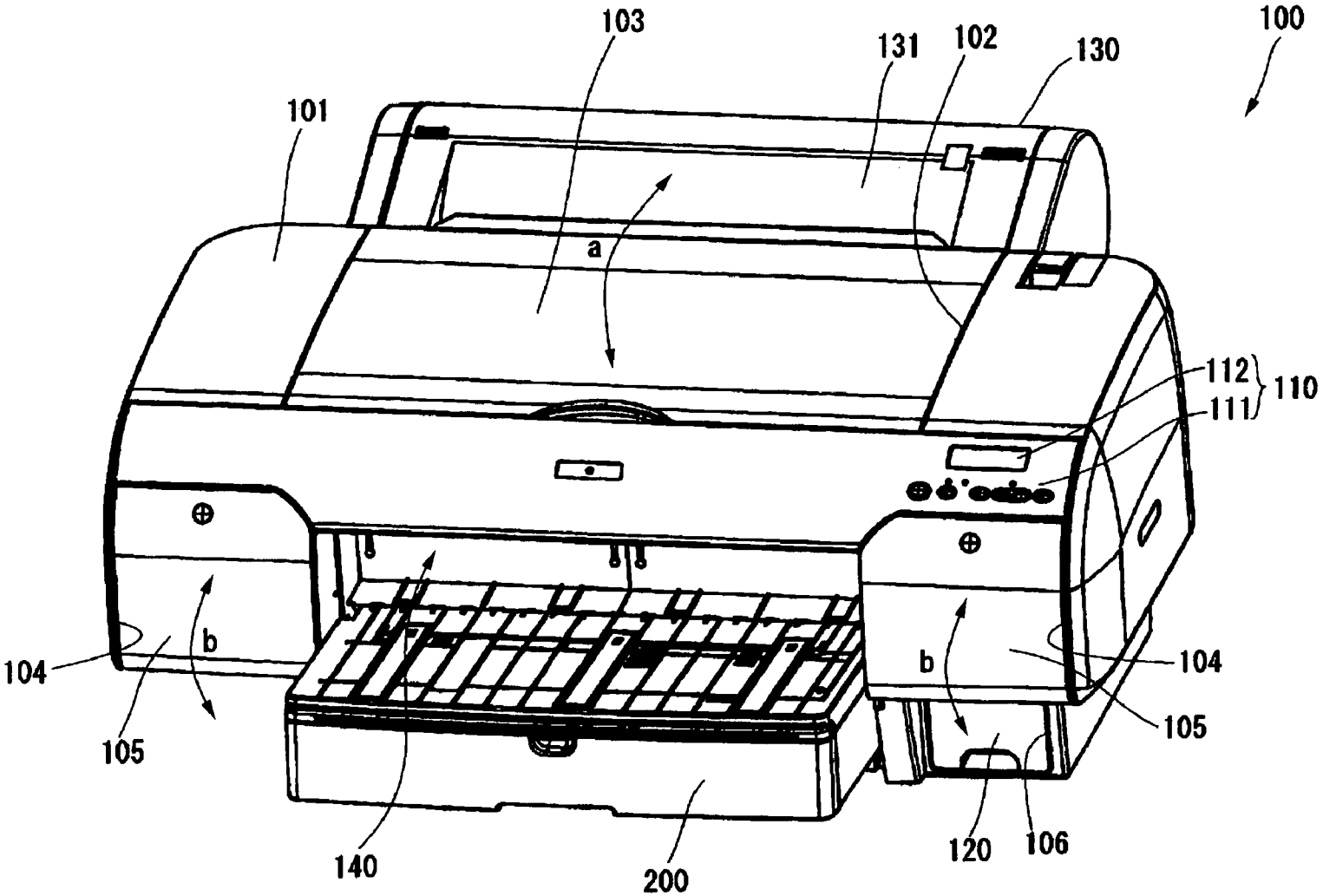
FIG. 1 is a perspective view of an ink jet printer incorporating a medium feeding device according to a first embodiment of the invention.

FIG. 1 shows an ink jet printer serving as a recording apparatus or an liquid ejecting apparatus. This ink jet printer 100 is a desktop large-sized printer enabled to print what is called cut sheet paper of a relatively large size, which ranges from, for example, JIS A4 size to JIS A2 size, and rolled sheet. The ink jet printer 100 is covered with a housing 101 shaped like a substantially rectangular parallelepiped, the entirety of which is elongated in a lateral direction.

A rectangular opening 102 is formed in the top face of this housing 101. This opening 102 is covered with a transparent or semi-transparent cover 103. The cover 103 is attached thereto to be able to pivot about a pivot shaft provided in an upper part thereof in a direction indicated by an arrow "a". A user can perform maintenance of an internal mechanism through the opening 102 by lifting the cover 103 to thereby open the opening 102.

Cartridge chambers 104, each of which accommodates plural ink cartridges, are formed on both sides of the front face of the housing 101. Each of the ink cartridges stores printing ink of a corresponding color. Each of the cartridge chambers 104 is covered with a transparent or semi-transparent cartridge cover 105. Each of the cartridge covers 105 is attached thereto to be able to pivot about a pivot shaft provided in a lower part thereof in a direction indicated by an arrow "b". A user can replace the ink cartridges by slightly pressing the cartridge covers 105 thereby to unfasten lock portions and to open the cartridge chambers 104.

A control panel 110 operative to designate an operation of the printer is disposed at an upper part of the cartridge chamber 104 that is provided on the right side of the front face of the housing 101, as viewed in this figure. The control panel 110 has a power system that is operative to turn on and off electric power, an operating system operative to set a print starting point on a sheet of paper and to perform flushing of ink, a button 111 of a processing system operative to perform image processing, and a liquid crystal panel 112 operative to display an operating state. A user can operate the button 111 while watching the liquid crystal panel 112 and checking the operating state.

A tank chamber 106, which accommodates a waste liquid tank 120, is formed in a lower part of the cartridge chamber 104 that is provided on the right side of the front face of the housing 101, as viewed in this figure. This waste liquid tank 120 stores waste ink that is wasted when cleaning a recording head 162 (see FIG. 9) and when replacing the ink cartridges. A user can replace the waste ink stored in the waste liquid tank 120 by drawing out the waste liquid tank 120.

A sheet feeder 130, which feeds a rolled sheet, is disposed on the rear face of the housing 101 to be able to project upwardly and rearwardly. A rolled sheet holder (not shown), in which a rolled sheet can be held, is disposed in the sheet feeder 130. A rolled sheet cover 131 is attached to the front face of the sheet feeder 130 to cover the rolled sheet holder. A user can attach and detach the rolled sheet by lifting the rolled sheet cover 131 to thereby open the sheet feeder 130. Incidentally, the top face of the rolled sheet cover 131 serves as a guide face enabled to manually feed a cut sheet therefrom.

A sheet feeder/ejector (that is, a medium feeding device) 140 is formed at the center of the front face, that is, between paired cartridge chambers 104. An automatic sheet feeding/ejection tray 200, which is used when a sheet of paper is automatically fed and ejected, is disposed in this sheet feeding/ejection 140. Also, a manual sheet feeding tray 300 (see FIG. 2B), which is used when a cut sheet is manually fed, is disposed on the automatic sheet feeding/ejection tray 200. Unprinted cut sheets are stacked in the automatic sheet feeding/ejection tray 200 and printed cut sheets or a printed rolled sheet is put on the automatic sheet feeding/ejection tray 200. Unprinted cut sheets or sheets of thick paper, which cannot be folded when conveyed, are stacked on the manual sheet feeding tray 300.

Figure 2A:
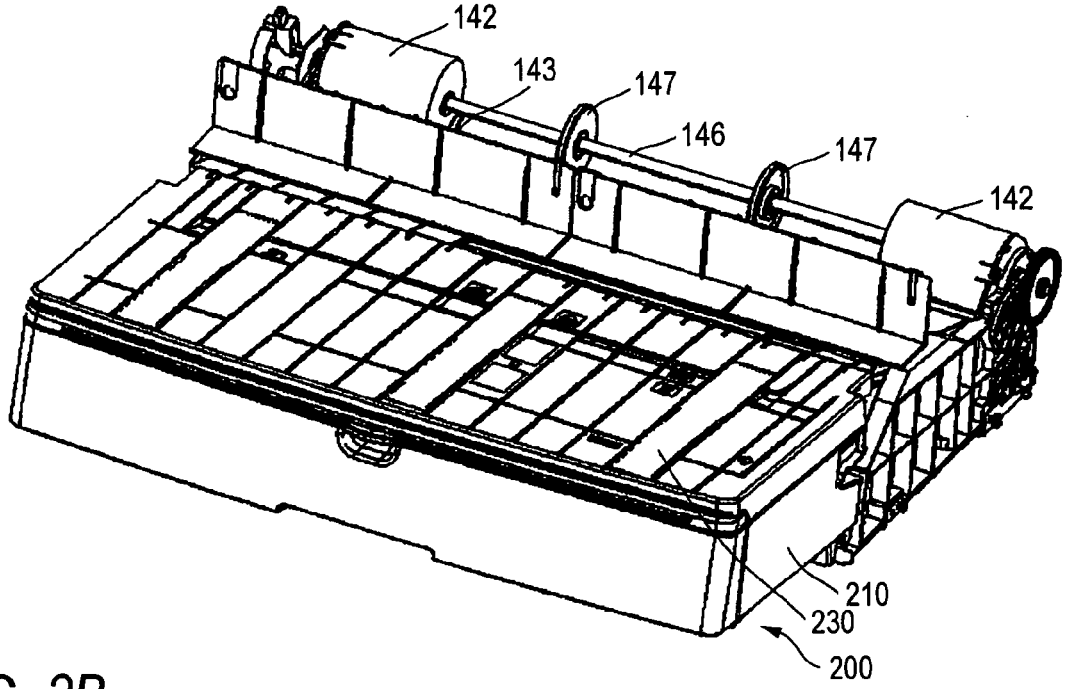
FIG. 2A is a perspective view of the medium feeding device, showing an automatic sheet feeding/ejection tray.
Figure 2B:
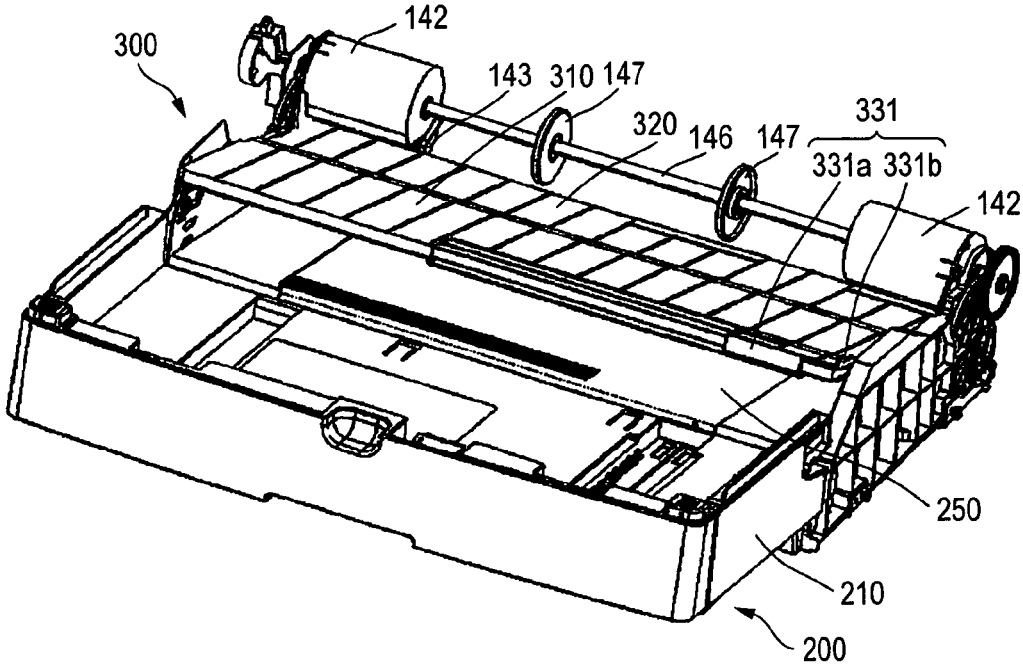
FIG. 2B is a perspective view of the medium feeding device, showing a manual sheet feeding tray.

As shown in FIGS. 2A and 2B, the automatic sheet feeding/ejection tray 200 has a first sheet feeding tray 210 formed like a box whose rear and top sides are opened, a sheet ejection tray 230 formed like a lid covering the opened top side of this first sheet feeding tray 210, and a second sheet feeding tray 250 formed like a box whose front and top sides are opened.

The opened rear side of the first sheet feeding tray 210 is inserted into the opened front side of the second sheet feeding tray 250. Unprinted cut sheets to be automatically fed are stacked and accommodated in a box-shaped space defined by the first sheet feeding tray 210 and the second sheet feeding tray 250. The sheet ejection tray 230 is attached to the opened top side of the first sheet feeding tray 210. Printed cut sheets are stacked or a rolled sheet is accumulated and put on this sheet ejection tray 230. The details of the structure of this automatic sheet feeding/ejection tray 200 are described hereinbelow by referring to FIGS. 3 to 5.

Figure 3:
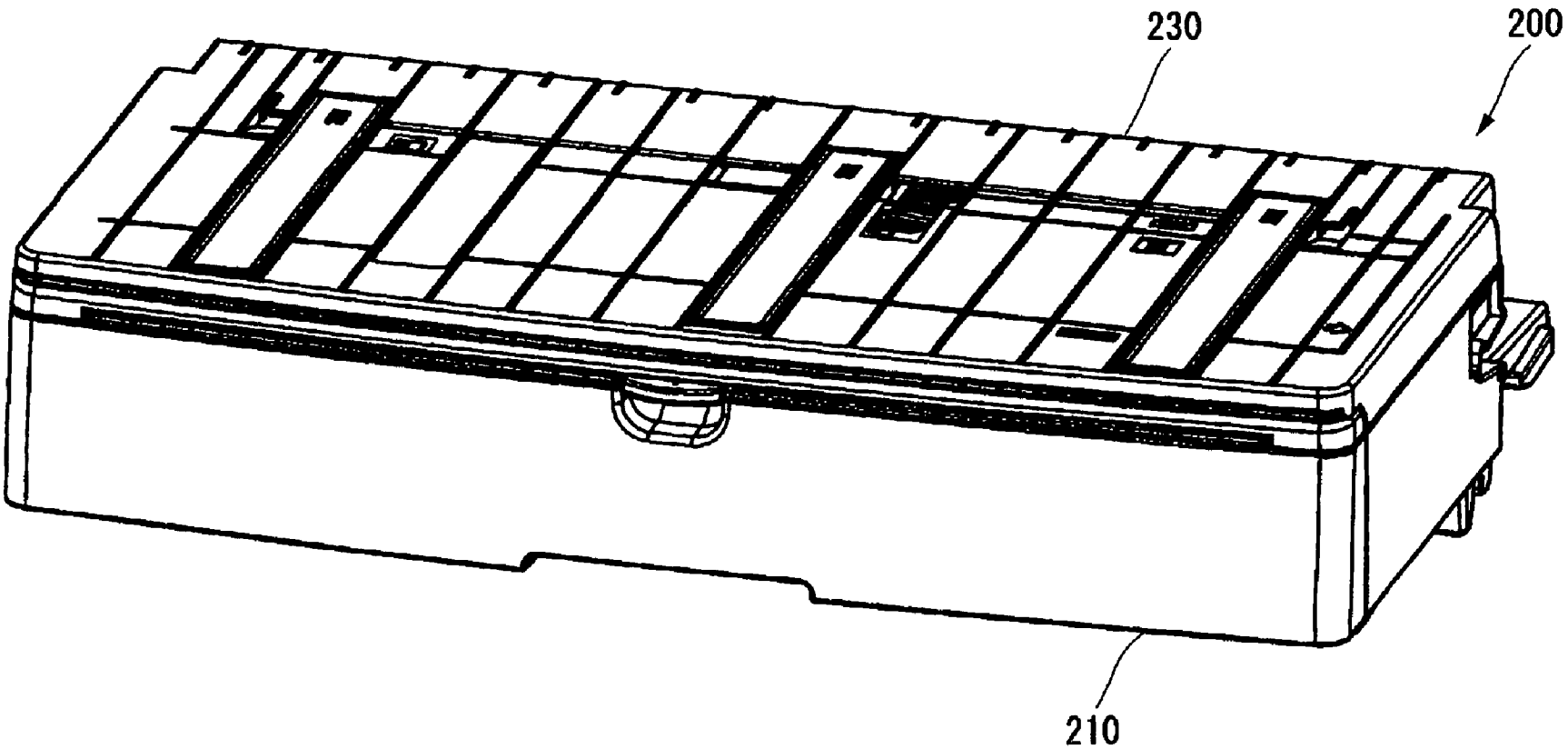
FIG. 3 is a perspective view of a first sheet ejection tray and a sheet ejection tray in the medium feeding device.

As shown in FIG. 3, the first sheet feeding tray 210 and the sheet ejection tray 230 are formed to be retractable in a sheet feeding/ejecting direction, and can be retracted in a compact manner when unused. The first sheet feeding tray 210 and the sheet ejection tray 230 can handle various sizes of cut sheets when used.

Figure 4:
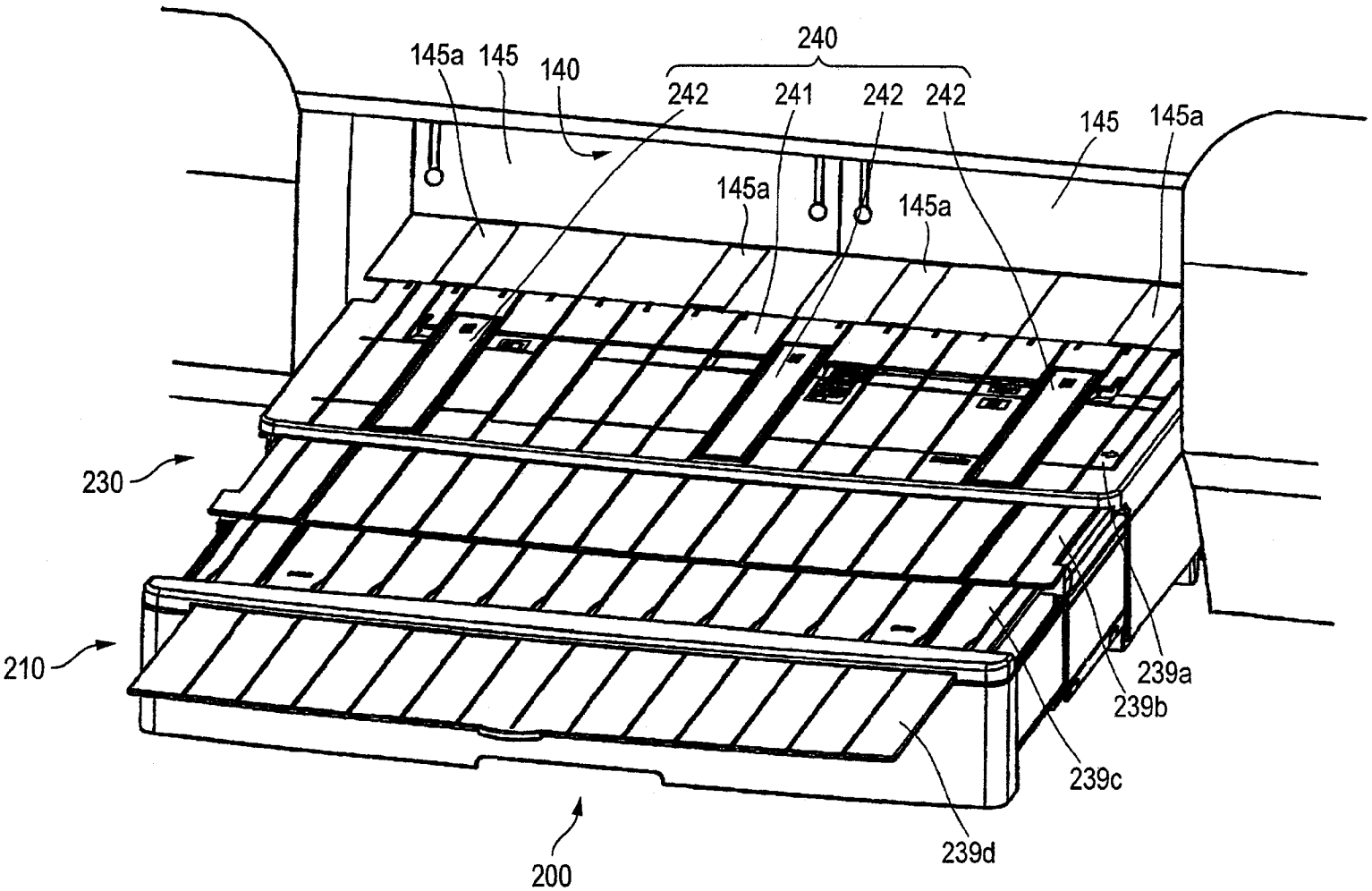
FIG. 4 is a perspective view of the automatic sheet feeding/ejection tray, showing a state that cut sheets are to be ejected.

In a case where cut sheets are stacked on the sheet ejection tray 230, as shown in FIG. 4, a rolled sheet guide 240 is made flush with the top face of a tray member 239*a*. Consequently, cut sheets to be ejected through a sheet ejecting roller 155 (see FIG. 9) are smoothly stacked on a sheet receiving face defined by side faces and a bottom face of a guide portion 145 and top faces of tray members 239*a* to 239*d*.

Incidentally, a sponge mat 145*a* is stuck to the bottom face of the guide portion 145. This sponge mat 145*a* has an anti-slip function of preventing, when a cut sheet is ejected thereto after another cut sheet is stacked, the former cut sheet from being pushed off the sheet receiving face by a leading edge of the latter cut sheet.

Figure 5:
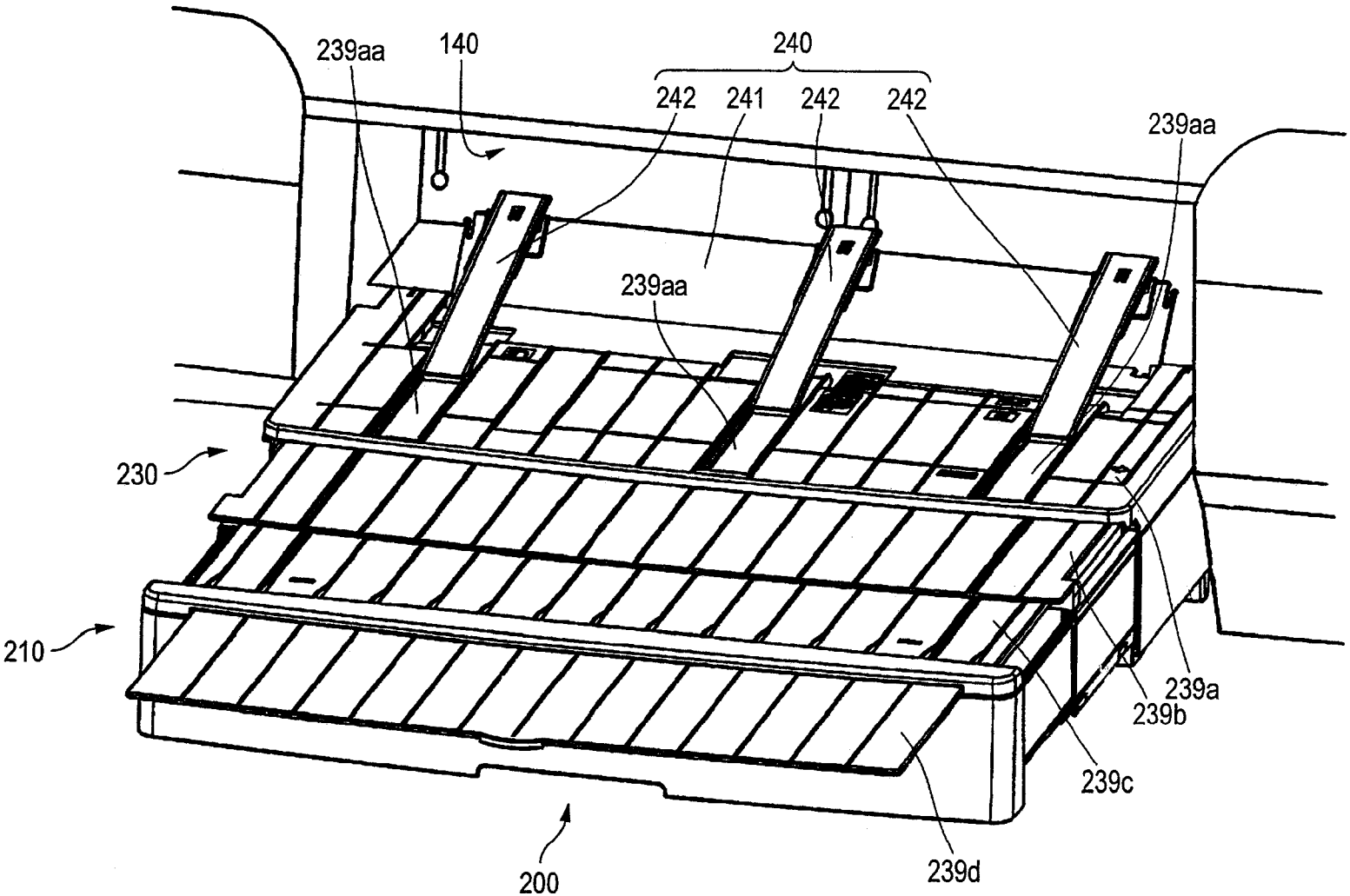
FIG. 5 is a perspective view of the automatic sheet feeding/ejection tray, showing a state that a rolled sheet is to be ejected.

Meanwhile, in a case where a rolled sheet is accumulated and put on the sheet ejection tray 230, as shown in FIG. 5, a user gets his figure caught on the rear portion of a first guide plate 241 of the rolled sheet guide 240 put on the top face of the tray member 239*a* to thereby lift the first guide plate 241. Then, each of second guide plates 242 is pulled by the first guide plate 241, so that one longitudinal end of each of the second guide plates 242 is lifted and that the other longitudinal end thereof rearwardly slides along a corresponding groove 239*aa* formed in the top face of the tray member 239*a*. Subsequently, the first guide plate 241 is turned until the angle formed between the first guide plate 241 and each of the guide plates 242 becomes an acute angle.

Consequently, the one longitudinal end side of each of the second guide plates 242 comes close to the top part of the side of the guide portion, so that each of the second guide plates 242 is placed like a slide. Thus, even when the rolled sheet ejected through the sheet ejecting roller is curled, an edge thereof is not caught in the guide portion. The edge of the rolled sheet glides on the slide-shaped second guide plates 242 and is led to the top faces of the tray members 239*a* to 239*d*. Hence, the rolled sheet is smoothly accumulated and put on the sheet receiving face.

Next, the manual sheet feeding tray 300 is described hereinbelow. As shown in FIG. 2B, the manual sheet feeding tray 300 has a lid-shaped body portion 310, which covers the front half of the opened top side of the second sheet feeding tray 250, and also has a lid-shaped extensible portion 320 covering the rear half of the opened top side of the second sheet feeding tray 250. The extensible portion 320 can freely be extended from and retracted to the body portion 310. That is, when extended, the extensible portion 320 protrudes from the body portion 310. When retracted, the extensible portion 320 is contained in the body portion 310.

The body portion 310 is mounted on the opened top side of the second sheet feeding tray 250. The extensible portion 320 is extended therefrom. Unprinted cut sheets or sheets of thick paper, which cannot be folded when conveyed, are stacked on the body portion 310 and an upper part of the extensible portion 320. The details of the structure of such a manual sheet feeding tray 300 are described hereinbelow by referring to FIGS. 6A to 8B.

Figure 6A:
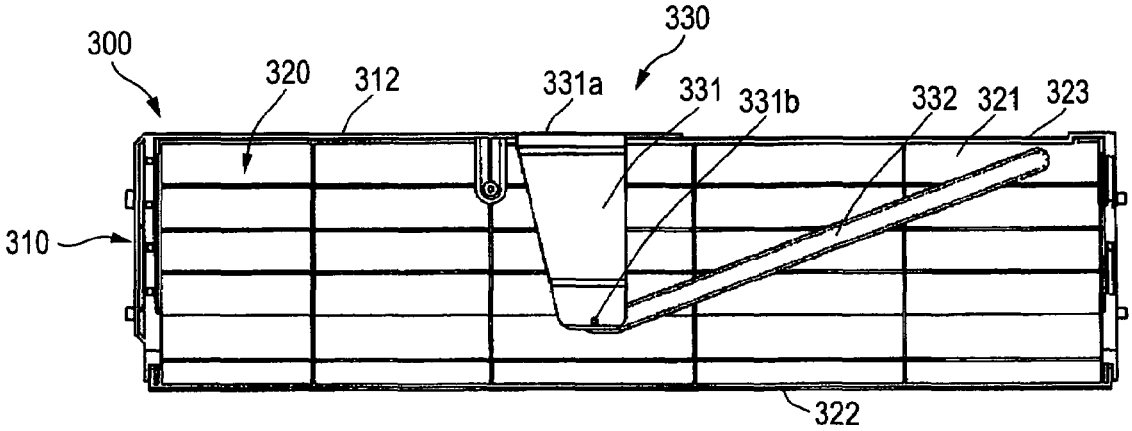
FIG. 6A is a plan view of the manual sheet feeding tray, showing a state that an extensible portion is contained in a body portion.

As shown in FIG. 6A, the body portion 310 is formed like a rectangular plate. The extensible portion 320 is formed like a rectangular plate, which is slightly smaller than the body portion 310. Consequently, the extensible portion 320 can be contained in a rear part 311 of the body portion 310. The extensible portion 320 can be extended from and retracted to the body portion 310 by a lever mechanism 330. That is, as shown in FIGS. 2B and 6A, a lever 331 enabled to freely slide between the substantial center of a front edge 312 and the right side along the front edge 312 is attached to the body portion 310, as viewed from the front thereof in FIG. 2B.

Figure 6B:
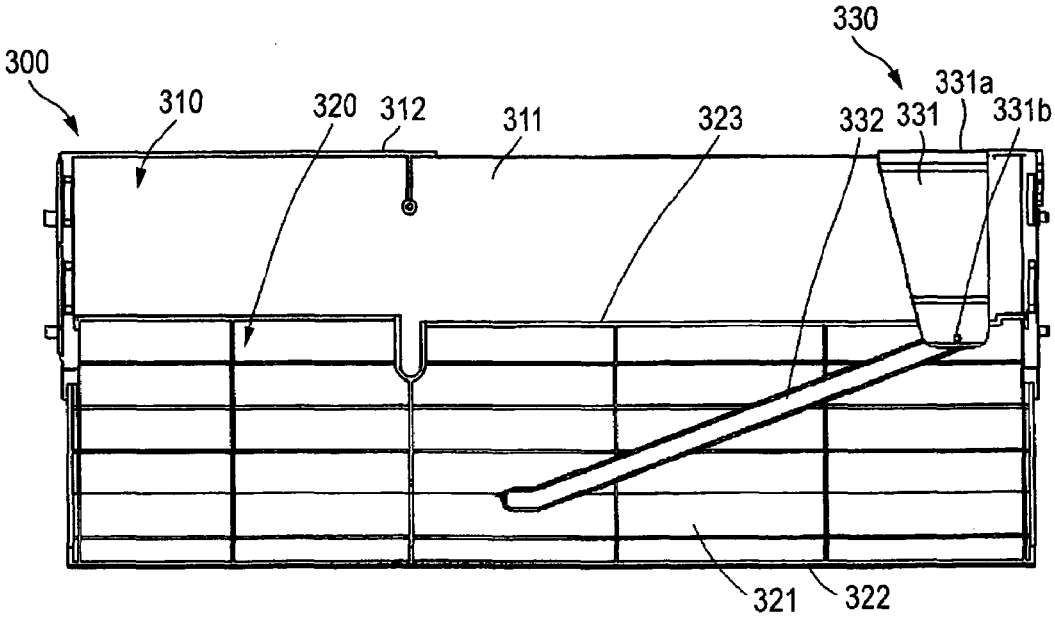
FIG. 6B is a plan view of the manual sheet feeding tray, showing a state that the extensible portion is extended from the body portion.

This lever 331 is formed like a plate whose cross-section taken along line extending a front edge 312 to the rear face 311 of the body portion 310 is substantially L-shaped. A front portion 331*a* thereof is caught on the front edge 132 of the body portion 310. A rear portion 331*b* is caught in a cam groove 332 formed in a rear face 321 of the extensible portion 320. This cam groove 332 is formed like a straight line inclined from a rear edge 322 to a front edge 323 of the extensible portion 320. That is, as shown in FIG. 6A, the rear portion 331*b* of the lever 331 is placed to the side of a rear edge 322 of the extensible portion 320 when the front portion 331*a* of the lever 331 is placed at the substantially center of the front edge 312 of the body portion 310. As shown in FIG. 6B, the rear portion 331*b* is placed to the side of a rear edge 322 of the extensible portion 320 when the front portion 331*a* of the lever 331 is placed at the right side, as viewed from the front of the front edge 312 of the body portion 310.

Thus, a user causes the lever 331 to slide along the front edge 312 of the body portion 310 to the substantially center of the front edge 312 to thereby make the rear portion 331*b* of the lever 331 move along the cam groove 332 to the rear edge 322 of the extensible portion 320. Consequently, as shown in FIG. 6A, the extensible portion 320 can be housed by being contracted, as compared with the body portion 310. Also, a user causes the lever 331 to slide along the front edge 312 of the body portion 310 to the right side, as viewed from the front in FIG. 2B, to thereby make the rear portion 331*b* of the lever 331 move along the cam groove 332 to the front edge 323 of the extensible portion 320. Consequently, as shown in FIG. 6B, the extensible portion 320 can be extended and protruded from the body portion 310. Incidentally, a gear or a pulley may be used instead of the above cam mechanism.

Further, as shown in FIG. 2B, a projection 331*c* extending in a sheet feeding direction is formed at the right side of the lever 331. This projection 331*c* serves as a grip portion used when the lever 331 is operated. The projection 331*c* placed at the right side of the front edge 312 of the body portion 312, as viewed from the front thereof. Thus, the projection 331*c* serves as a side edge guide that guides a side edge of a cut sheet to be manually fed. Consequently, sheet feeding accuracy can be enhanced. Furthermore, the projection 331*c* is placed at the substantially center of the front edge 312 of the body portion 310 when the extensible portion 320 is contracted. Thus, the projection 331*c* serves as an ingression preventing member adapted to prevent the ingression of manually fed paper. Consequently, the manually fed paper can be prevented from interfering with a sheet of paper that is being automatically fed.

Figure 7B:
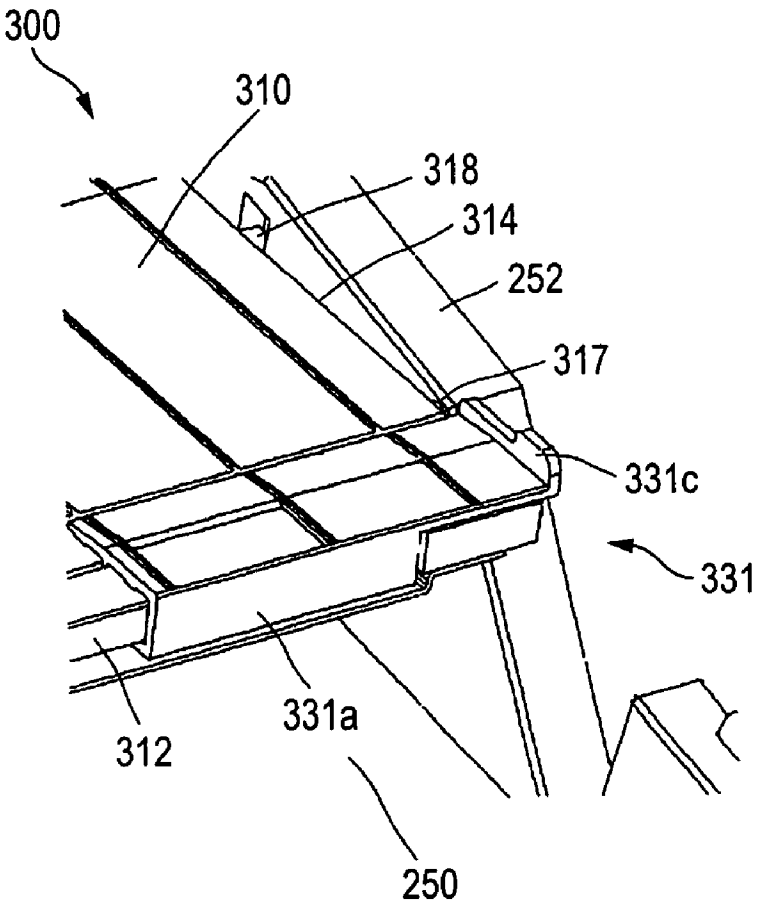
FIG. 7B is an enlarged perspective view of a right end portion of the manual sheet feeding tray.
Figure 7A:
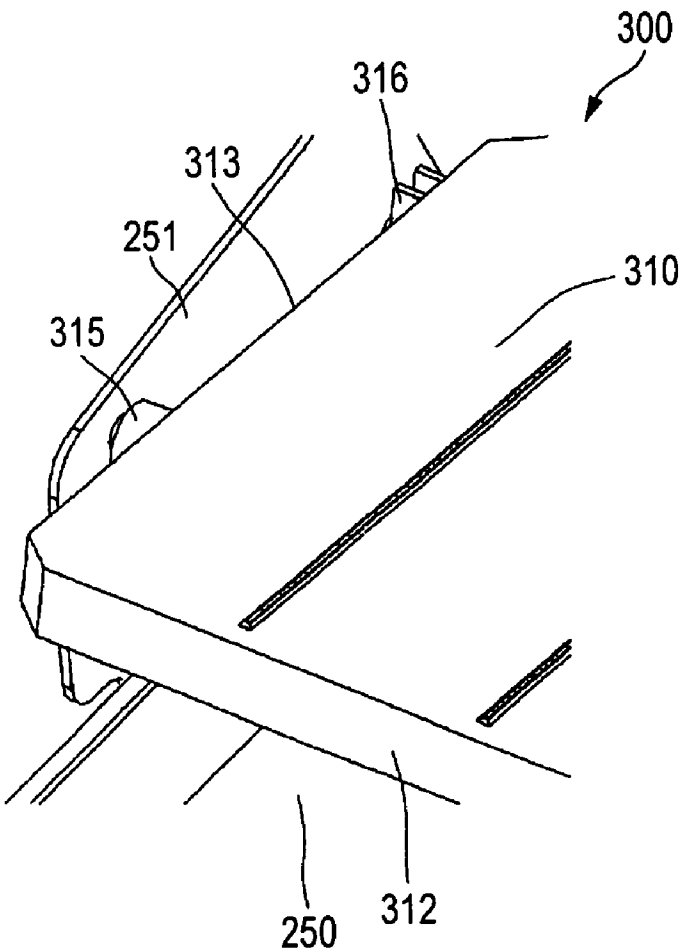
FIG. 7A is an enlarged perspective view of a left end portion of the manual sheet feeding tray.

As shown in FIGS. 7A and 7B, both side parts 313 and 314 of the body portion 310 of the manually sheet feeding tray 300 are caught in both side walls 251 and 252 of the second sheet feeding tray 250 of the automatic sheet feeding/ejection tray 200, respectively. As shown in FIG. 7A, a cylindrical projection 315 and a set of plate-shaped projections 316 disposed in parallel to each other are formed on a right side part 313 of the body portion 310 at predetermined intervals to be arranged from the front edge 312. Also, as shown in FIG. 7B, two cylindrical projections 317 and 318 are formed on a left side part 314 of the body portion 310 at a predetermined interval.

Figure 8B:
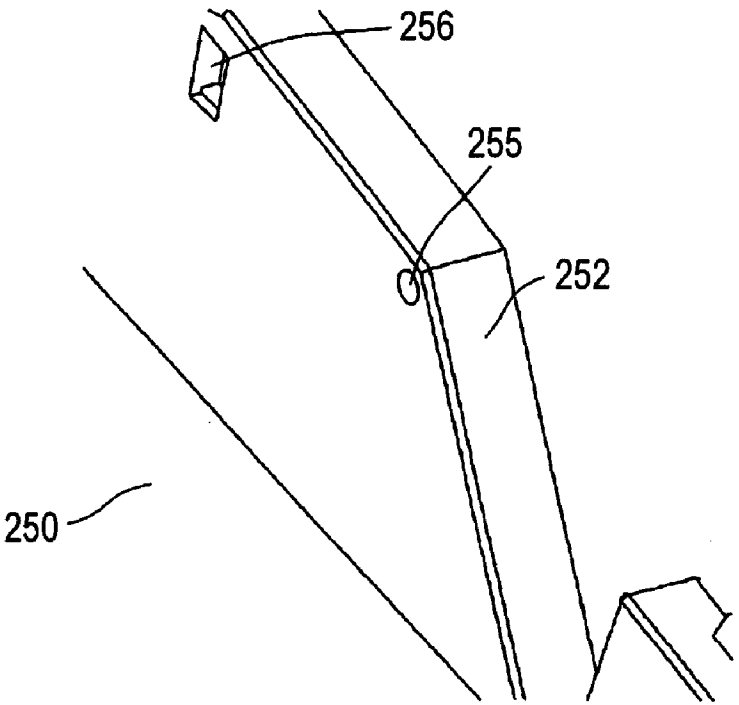
FIG. 8B is an enlarged perspective view of the portion of FIG. 7B, showing a state that the manual sheet feeding tray is removed.
Figure 8A:
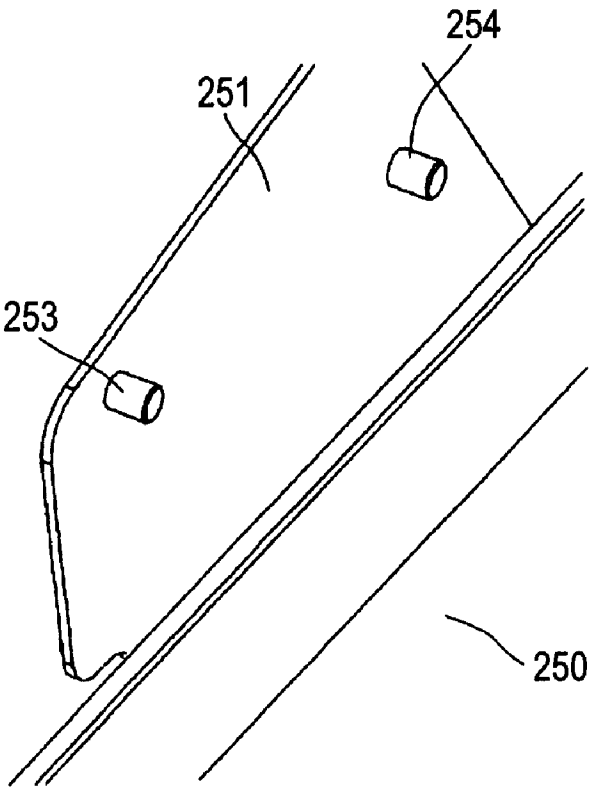
FIG. 8A is an enlarged perspective view of the portion of FIG. 7A, showing a state that the manual sheet feeding tray is removed.

Meanwhile, as shown in FIG. 8A, two cylindrical projections 253 and 254 are formed on a left side wall 251 of the second sheet feeding tray 250 at a predetermined interval to be arranged from the front. Further, as shown in FIG. 8B, a cylindrical hole 255 and a rectangular slot 256 are formed in a right side wall 252 of the second sheet feeding tray 250 at a predetermined interval to be arranged from the front. Furthermore, as shown in FIG. 7A, the two projections 253 and 254 formed in the left side wall 251 of the second sheet feeding tray 250 are inserted into a central hole of the projection 315 formed in the right side part 313 of the body portion 310 and a slit formed in the projection 316 thereof, respectively. Also, as shown in FIG. 7B, the two cylindrical projections 317 and 318 formed on the left side part 314 of the body portion 310 are inserted into the cylindrical hole 255 and the rectangular slot 256 formed in the right side wall 252 of the second sheet feeding tray 250, respectively. Consequently, the manual sheet feeding tray 300 can pivot upwardly by the length of the slot 256 about each of the projections 315 and 317, which serves as a pivot shaft, above the second sheet feeding tray 250.

Sheet feeding rollers 142 and pad supports 143 are disposed on both sides of a rear part of each of the automatic sheet feeding/ejection tray 200 and the manually sheet feeding tray 300 respectively shown in FIGS. 2A and 2B. That is, a roller shaft 146 extending so as to pass through the sheet feeding rollers 142 is rotatably supported on a side frame (not shown) at both ends thereof. Each of the pad supports 143 is disposed under the corresponding sheet feeding roller 142. Further, two auxiliary rollers 147 are disposed at a predetermined interval between the two sheet feeding rollers 142.

The sheet feeding rollers 142 are disposed to come contact with both sides of a cut sheet and are formed to have a relatively large width. Consequently, the pressure applied to the entire face of the sheet can be reduced while reducing the pressure applied from the sheet feeding rollers 142 to the sheet face per unit area at the supply of paper. Also, a middle portion of the cut sheet to supply can be pressed by the auxiliary rollers 147. Thus, a relatively wide cut sheet, for example, paper of JIS A2 size can be fed straightly by preventing such a sheet from being deflected in a direction of width thereof. Also, damage caused to an exclusive recording sheet by the sheet feeding rollers 142 can be suppressed.

Figure 9:
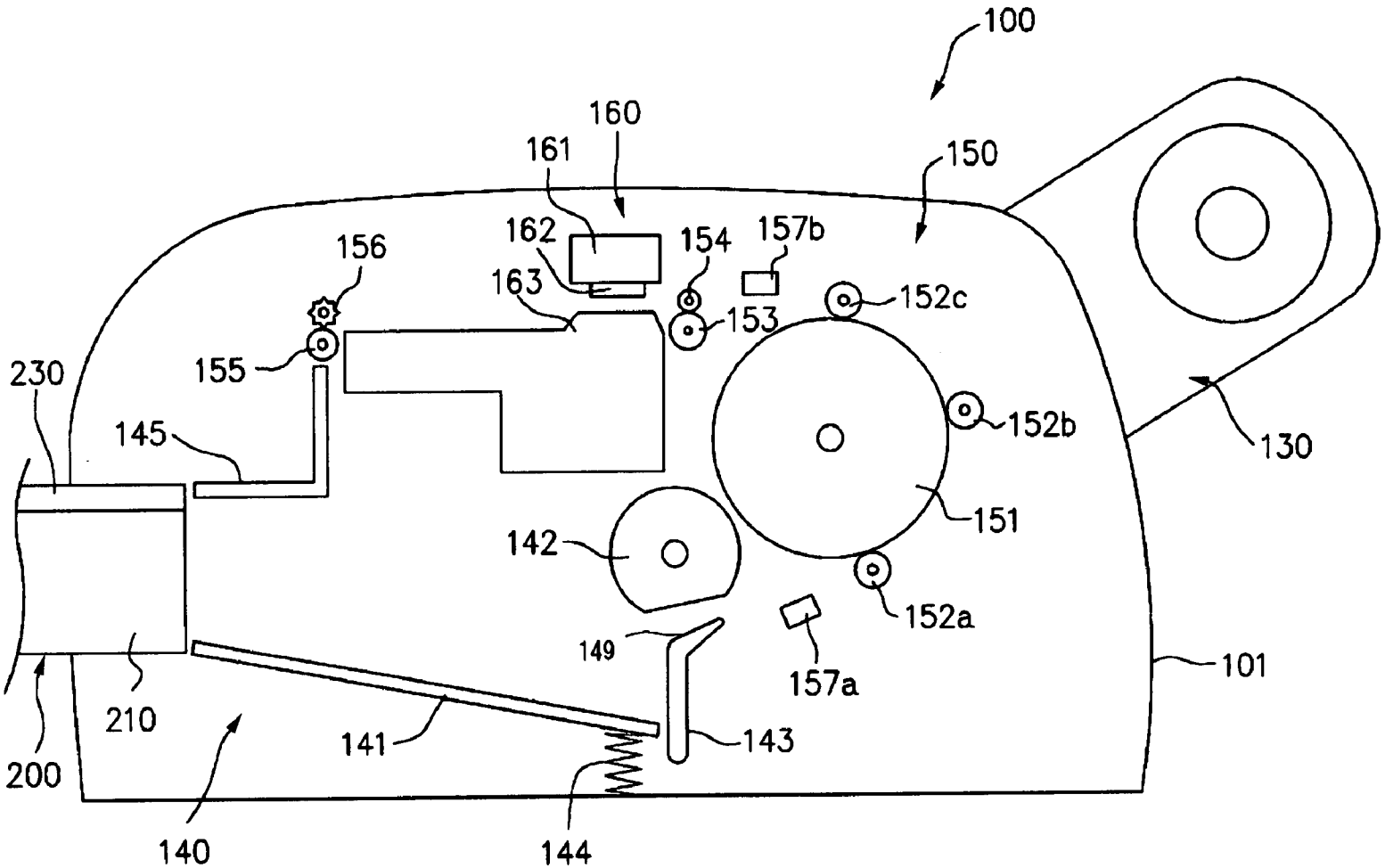
FIG. 9 is a schematic section view of the ink jet printer.

As shown in FIG. 9, the sheet feeder/ejector 140, a sheet transporter 150, and a recording section 160 are disposed in the housing 101. A hopper 141 operative to supply a cut sheet, the sheet feeding rollers 142, and the pad supports 143 each having a separation pad 149 are disposed in the sheet feeder/ejector 140. The hopper 141 is formed like a plate, on which a cut sheet can be put and is disposed so that an end of the hopper 141 is placed in the vicinity of each of the sheet feeding rollers 142 and the pad supports 143, while the other end thereof is placed close to the bottom face of the first sheet feeding tray 210 of the mounted automatic sheet feeding/ejection tray 200. Also, the hopper 141 is disposed so that an end of a compression spring 144, the other end of which is attached to the bottom face of the housing 101, is attached to the back face of one end of the hopper 141, so that the one end of the hopper 141 is pivoted about the other end thereof by expansion and contraction of this compression spring 144.

Each of the sheet feeding rollers 142 is formed so that a cross-section thereof is partially cutaway and is D-shaped. The sheet feeding roller 142 intermittently rotates to thereby friction-convey a cut sheet put on the hopper 141. The separation pad 149 frictionally separates, when the overlapped sheet feeding of the cut sheet is occurred, the lower cut sheet from the top cut sheet. Hereinafter, the relation between the cut sheet put on the hopper 141 and the sheet feeding roller 142 will be described.

Figure 10A:
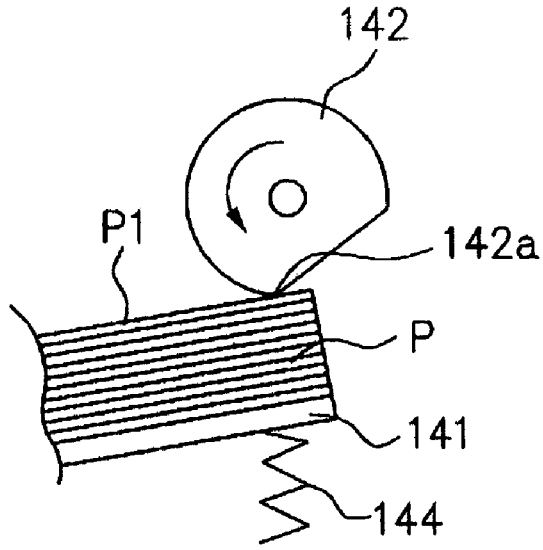
FIGS. 10A and 10B are diagrams showing a contact state between a sheet feeding roller and a cut sheet placed on a hopper in the medium feeding device.
Figure 10B:
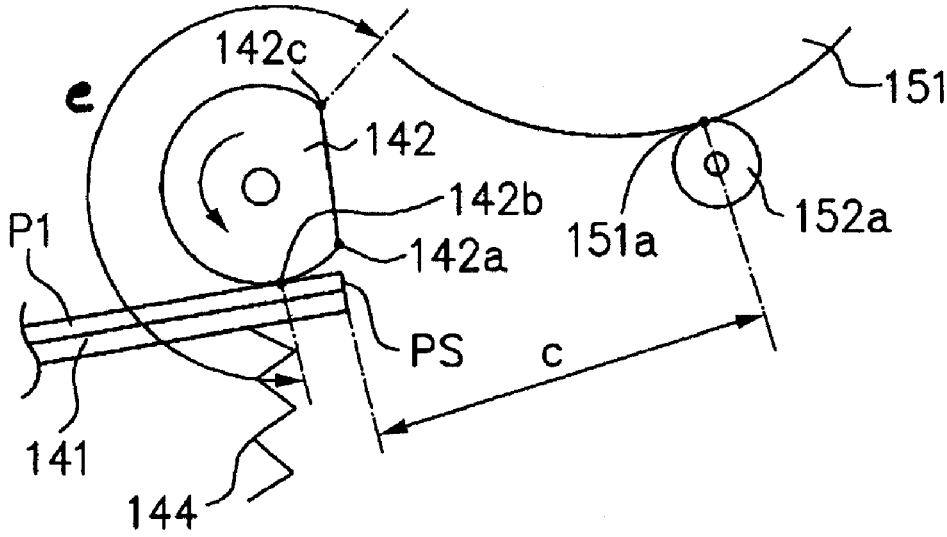

FIGS. 10A and 10B are views showing the contact state between the cut sheet put on the hopper 141 and the sheet feeding roller 142. FIG. 10A illustrates a case where a maximum limit number of cut sheets P is put on the hopper 141. In this case, the hopper 141 is adjusted so that when the hopper 141 rises, the top cut sheet P1 is not in contact with a flat portion of the sheet feeding roller 142, and that the cut sheet P1 is in contact with at least a part of a circumference from an end 142*a* of the flat portion.

FIG. 10B illustrates a case where a minimum limit number (that is, one) of cut sheets P1 is put on the hopper 141. In this case, the hopper 141 is adjusted so that when the hopper 141 rises, the cut sheet P1 is in contact with a point 142*b* to which the sheet feeding roller 142 is slightly turned from the end 142*a* of the flat portion. This contact point 142*b* is set so that each of the length of a part of a circumference "e" from the contact point 142*b* to the other end 142*c* of the flat portion and the interval between a leading end PS of the cut sheet P1 and a nip point 151*a* between a sub roller 151 and a follower roller 152*a* thereof is equal to a same length "c".

With the aforementioned arrangement, in a case where the number of the cut sheets P put on the hopper 141 is equal to or less than the maximum limit number, the cut sheet P1 is not released from the sheet feeding roller 142 until the leading end PS of the top cut sheet P1 reaches the nip point 151*a* between the sub roller 151 and the follower roller 152*a*. Consequently, the cut sheet P1 can reliably be transferred to the sub roller 151. Thus, it is possible to eliminate occurrences of the sheet feeding failure.

The sub roller 151 operative to convey the cut sheet, associated follower rollers 152*a*, 152*b*, and 152*c*, a sheet transporting roller 153, an associated follower roller 154, a sheet ejecting roller 155, a spur roller 156, and sensors 157*a*, and 157*b*, which are operative to detect a cut sheet or a rolled sheet, are disposed in the sheet transporter 150. The sub roller 151 and the follower rollers 152*a*, 152*b*, and 152*c* nip and convey a cut sheet such that a transporting direction is inverted toward the ejection roller 155. Further, the sub roller 151 and the follower roller 152*c* nip and convey a roller sheet toward the ejection roller 155.

The sheet feeding roller 153 and the follower roller 154 nip the cut sheet and convey the nipped sheet to a platen 163. The sheet ejecting roller 155 and the spur roller 156 nip the sheet, which is passed through the platen 163, and then ejects the nipped paper onto the sheet ejection tray 230. The sensor 157*a* is operative to detect an amount of the conveyed sheet when removing a skew of the sheet. The sensor 157*b* is operative to detect an amount of the conveyed sheet when setting a print starting point of the rolled sheet.

A carriage 161 and a recording head 162 are disposed in the recording section 160. The carriage 161 is connected to a carriage belt (not shown). When the carriage belt is operated by a carriage driving unit (not shown), the carriage 161 performs a reciprocating motion in response to the motion of the carriage belt by being guided along a guide shaft (not shown).

The recording head 162 has plural black ink recording heads, which eject plural kinds of black ink, for example, two kinds of black ink, and also has plural color ink recording heads, which eject, for instance, six kinds of color ink, such as yellow, dark yellow, cyan, light cyan, magenta, and light magenta ink Further, the recording head 162 also has a pressure generating chamber, and nozzle orifices communicated thereto. The recording head 162 is adapted to eject ink droplets, whose size is controlled, to the sheet from the nozzle orifices by pressurizing the ink stored in the pressure generating chamber.

An operation of printing a cut sheet by the ink jet printer 100 of such a configuration is described hereinbelow. The cut sheets P placed thereon are pushed against the sheet feeding roller 142 by the rise of the hopper 141, which is caused by restoration of the compression spring 144 mechanically in synchronization with the rotation of the sheet feeding roller 142. Thus, only the top cut sheet P is separated by the separation pad 143, and is fed to the sheet transporter 150.

Figure 15A:
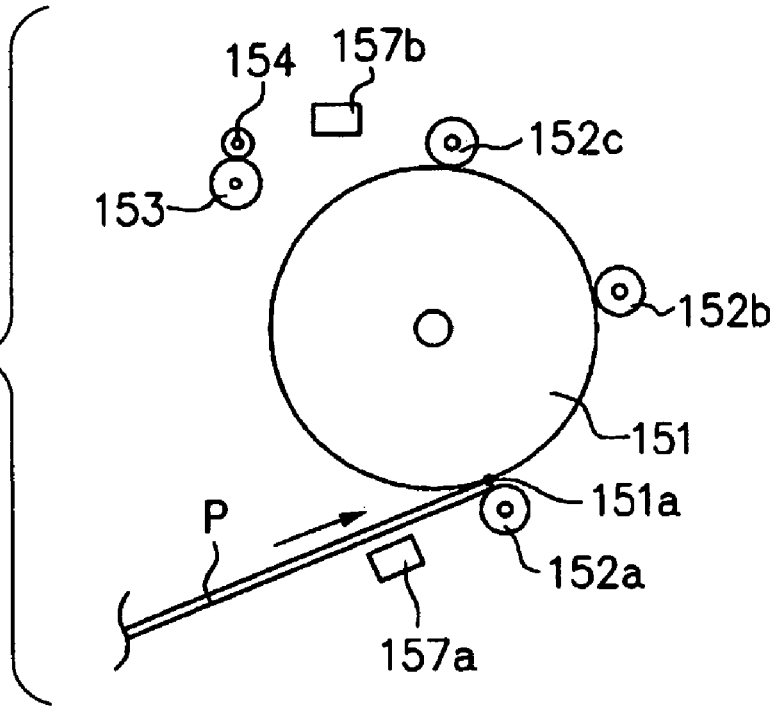
FIGS. 15A to 16B are diagrams showing the transport of a cut sheet from the medium feeding device to a recording head in the ink jet printer.

Then, as shown in FIG. 15A, when the cut sheet P to be supplied reaches the nip point 151*a* between the sub roller 151 and the corresponding follower roller 152*a*, a process of removing a skew from the cut sheet P is performed. Various methods may be employed according to the thickness of the paper as this process of removing a skew. That is, in a case of a cut sheet of thin paper, whose thickness is equal to or less than plain paper, the following method is employed. That is, first, a leading edge of the thin cut sheet is made to slightly enter between the sub roller 151 and the corresponding follower roller 152*a*. Subsequently, the rollers 151 and 152*a* are reversed to thereby bend the cut sheets. Thus, the skew of the leading edge of the cut sheets is removed. Incidentally, the moving amount of leading edge is detected by the sensor 157*a*. The skew removal is controlled according to the detected amount.

In a case of a cut sheet of thick paper, whose thickness is equal to or more than plain paper, the following method is employed, That is, a leading edge of the cut sheet is made to abut against the nip point 151*a* between the sub roller 151 and the corresponding follower roller 152*a*. Subsequently, the sheet feeding roller 142 is caused to slip. Thus, the skew of the leading edge of the cut sheet is removed Incidentally, the moving amount of leading edge is detected by the sensor 157*a*. The skew removal is controlled according to the detected amount.

The reasons for changing the method of skew removal are as follows. First, because the thin cut sheets are fragile, there is an anxiety that the sheet feeding roller 142 may feed the cut sheet without slipping on the thin cut sheet. Second, because the thick cut sheet is produced by sticking cut sheets together, there is an anxiety that when the rollers 151 and 152*a* are reversed, the stuck thin cut sheets are peeled off.

Figure 15B:
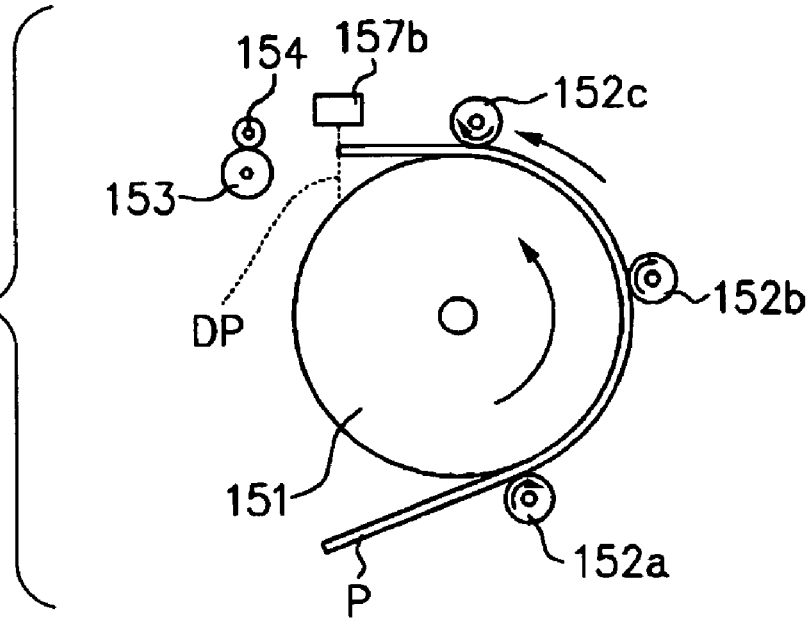

Upon completion of the skew removal, the cut sheet P is nipped by the sub roller 151, which is driven by a sheet transporting motor (not shown), and the corresponding follower rollers 152*a*, 152*b*, and 152*c*, and subsequently, is conveyed in a direction opposite to a direction in which the cut sheet is supplied. When an edge of the cut sheet P reaches a detecting position DP, at which the leading edge is detected by the sensor 157*b*, as shown in FIG. 15B, the setting of a print starting point, that is, the positioning of a print starting point on the cut sheet P is performed.

Figure 16A:
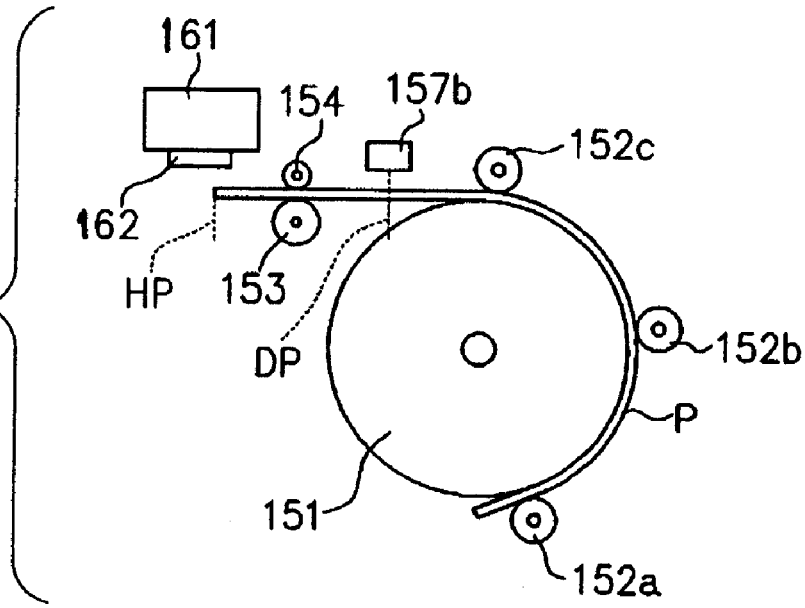

That is, the amount of the conveyed cut sheet P is detected by the sensor 157*b* until the edge of the cut sheet P reaches the setting position HP shown in FIG. 16A after conveyed from the detecting position DP and passed through between the sheet feeding roller 153 and the corresponding follower roller 154. The positioning of the print starting point is controlled according to the detected amount. The positioning of the print starting point is performed by using the sensor 157*b* disposed downstream from the sub roller 151. Especially, an error in positioning the print starting point due to the thickness of the paper is eliminated. Consequently, the accuracy in positioning the print starting point can be enhanced.

Figure 16B:
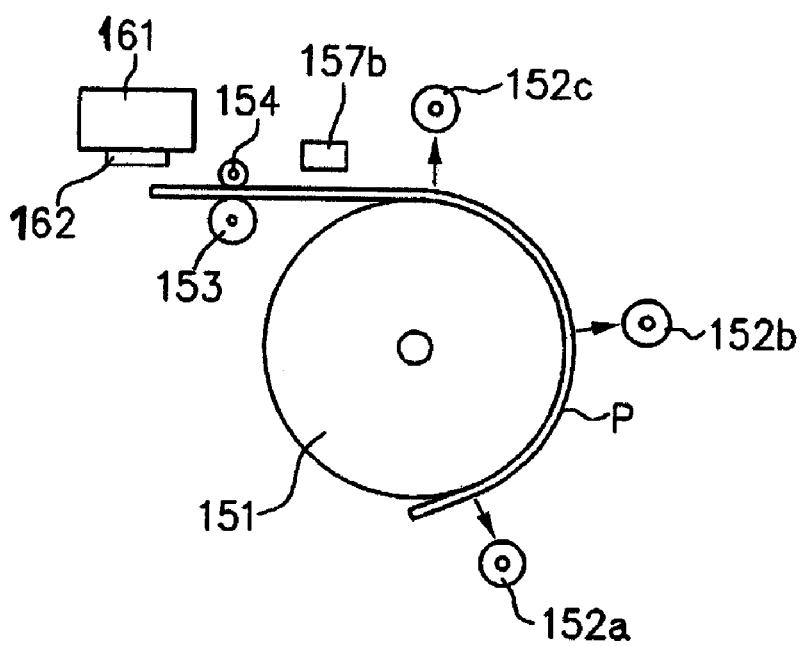

Thereafter, upon completion of positioning of the print starting point, the cut sheet P is nipped by the sheet feeding roller 153, which is driven by the sheet transporting motor (not shown), and the corresponding follower roller 154 and is then conveyed to the recording section 160. Further, the nipping of the cut sheet P by the sub roller 151 and the follower rollers 152*a*, 152*b*, and 152*c* may degrade the conveying accuracy. Thus, as shown in FIG. 16B, the follower rollers 152*a*, 152*b*, and 152*c* are released from the sub roller 151.

The cut sheet P to be conveyed is sucked by a suction pump (not shown) onto the platen 163. Then, the cut sheet P is made to be flat thereon. Subsequently, the cut sheet P is subjected to printing performed by the recording head 162 mounted on the carriage 161. At that time, a controller of the ink jet recording apparatus 100 causes the ink cartridges, which respectively correspond to seven colors, for example, yellow, dark yellow, magenta, light magenta, cyan, light cyan, and black, to supply color ink to the recording head 162. The controller controls timing, with which color ink is ejected, and operations of driving the carriage 161 and the sheet feeding roller 153, and performs a high-precision ink dot control operation and a halftoning operation. Then, upon completion of printing, the cut sheet P is nipped by the sheet ejecting roller 155, which is driven by the sheet transporting motor (not shown), and the spur roller 156 and is ejected to the sheet feeder/ejector 140. Finally, the sheet of paper P is stacked on the sheet ejection tray 230 of the automatic sheet feeding/ejection tray 200.

Figure 11A:
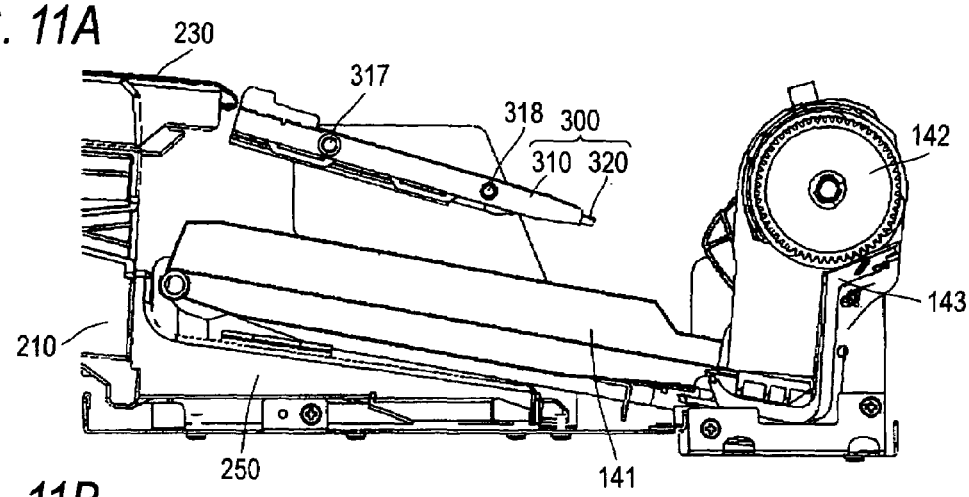
FIG. 11A is a side view showing a state that the extensible portion of the manual sheet feeding tray is contained in the body portion thereof.
Figure 11B:
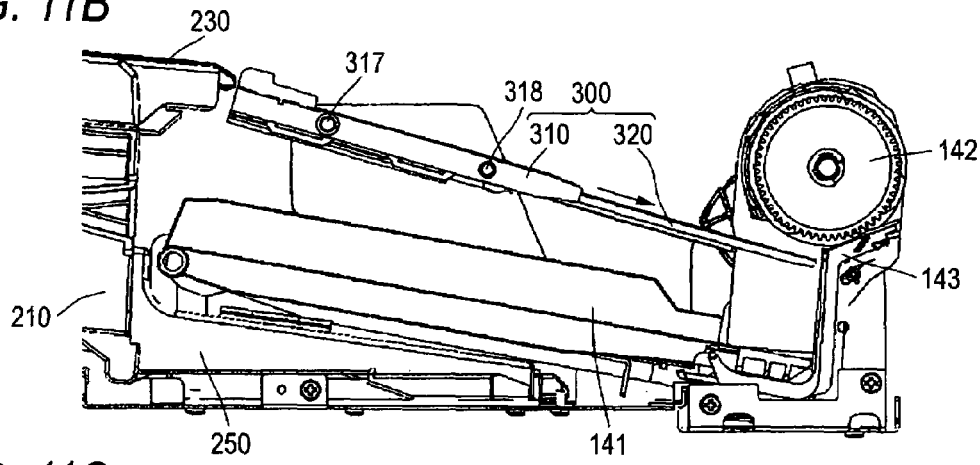
FIG. 11B is a side view showing a state that the extensible portion is extended from the body portion.

FIG. 11A shows a state, in which the manual sheet feeding tray 300 is mounted on the second sheet feeding tray 250. The body portion 310 is placed substantially in parallel to the hopper 141. The extensible portion 320 is contained in the body portion 310. Subsequently, as shown in FIG. 11B, a user operates the lever 331 to thereby cause the extensible portion 320 to project from the body portion 310 such that an end of the extensible portion 320 reaches a point located under the sheet feeding roller 142.

Figure 11C:
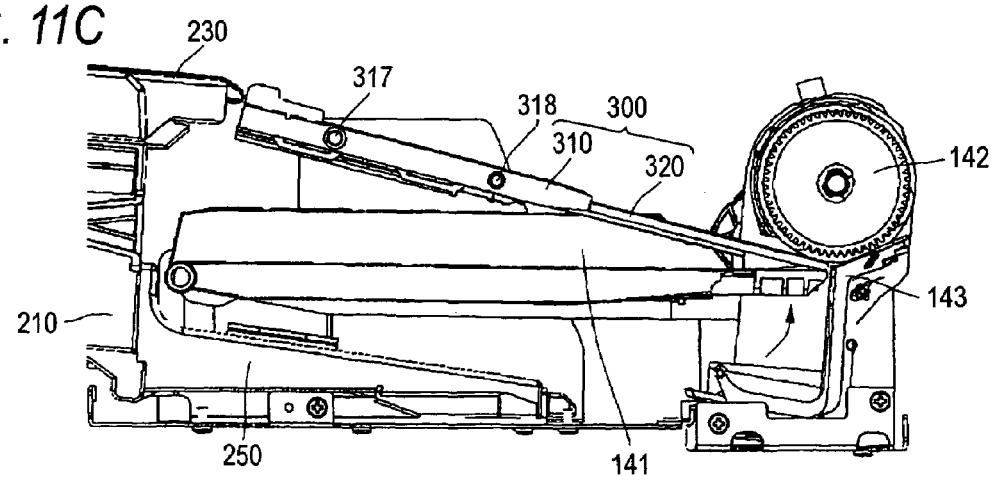
FIG. 11C is a side view showing a state that the extensible portion is lifted by the hopper.

Subsequently, as shown in FIG. 11C, the hopper 141 is lifted. Then, an end of the hopper 141 abuts against and pushes up the end of the extensible portion 320. Thus, the manual sheet feeding tray 300 upwardly pivots about each of the projections 315 and 317 by the length of the slot 256. Thus, the end of the extensible portion 320 abuts against the sheet feeding roller 142. Therefore, the cut sheet which is put on the manual sheet feeding tray 300, is fed with high precision, as described by referring to FIGS. 10A and 10B. Further, even when a cut sheet to be automatically fed is left in the automatic sheet feeding tray 200, the cut sheet to be manually fed is not in contact with the cut sheet to be automatically fed. Thus, both the cut sheets are not stuck to each other.

Figure 12:
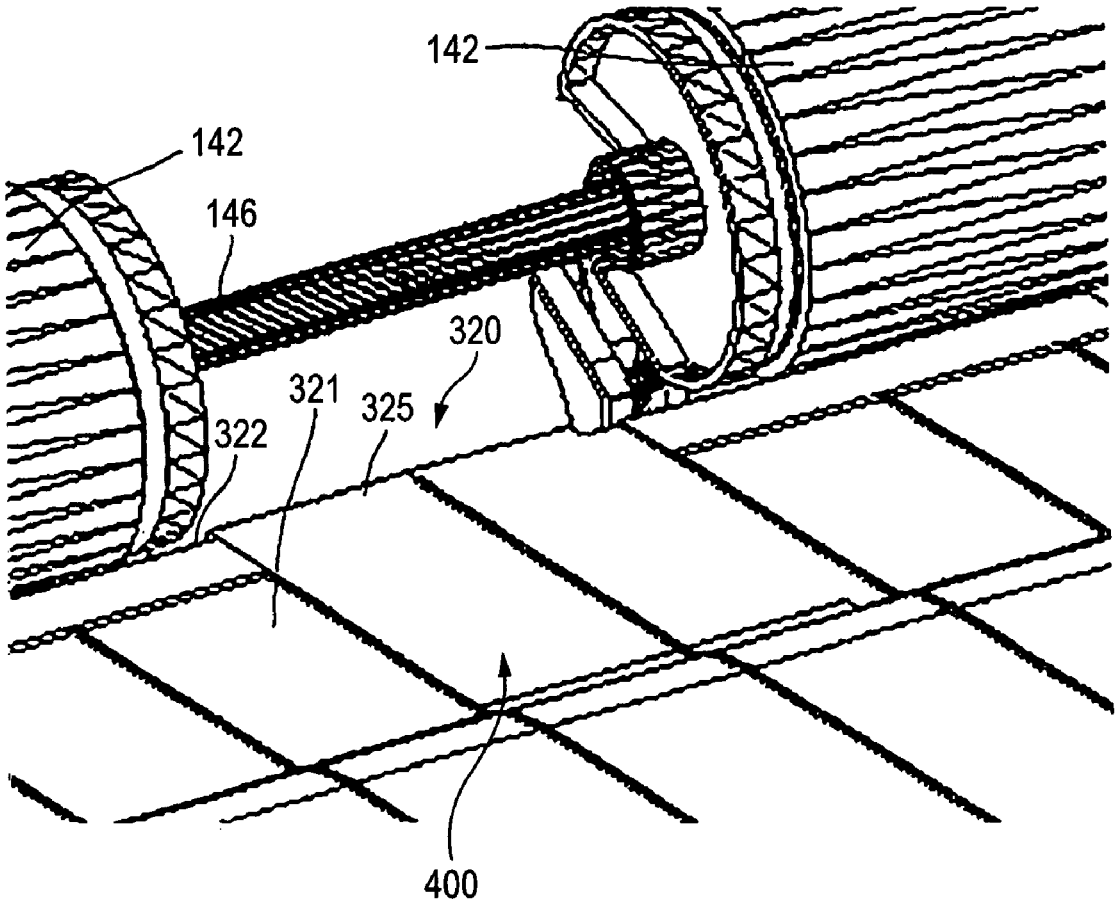
FIG. 12 is an enlarged perspective view of a manual sheet feeding tray according to a second embodiment of the invention, viewed from a front side thereof.
Figure 13:
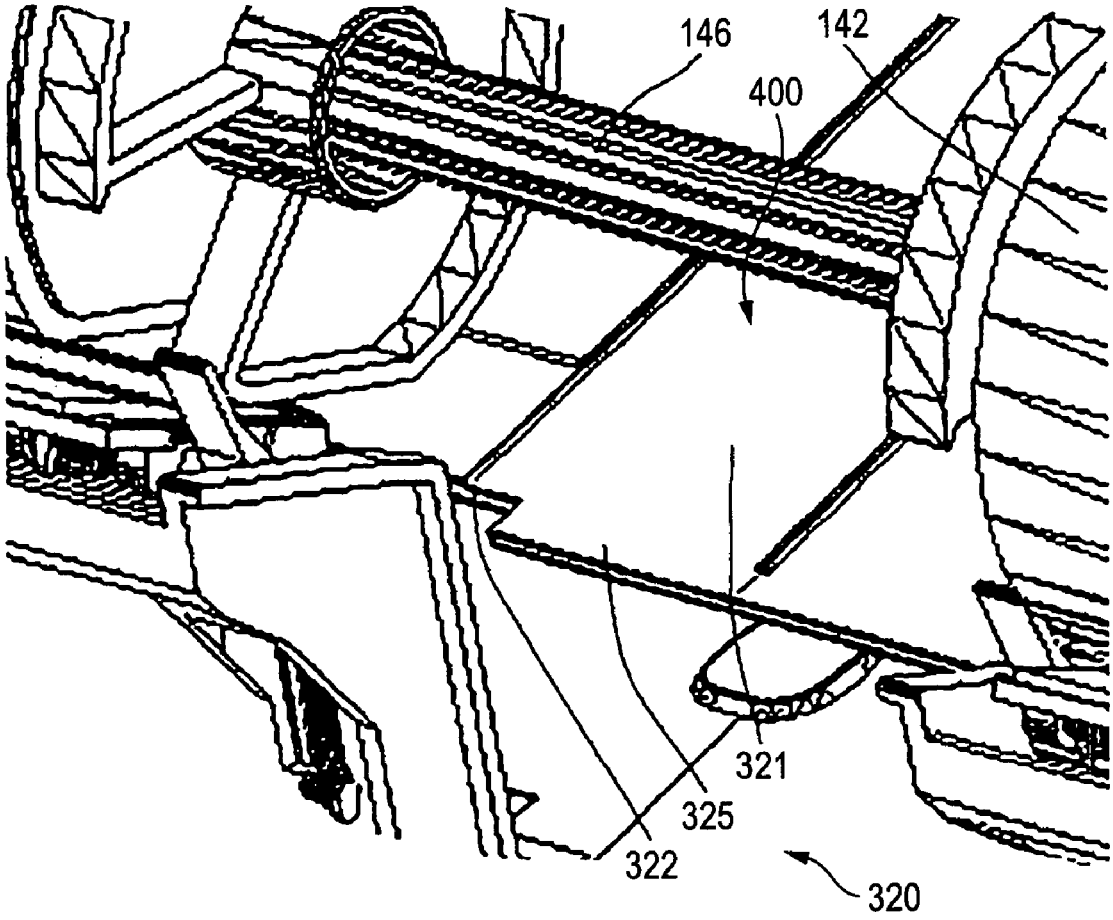
FIG. 13 is an enlarged perspective view of the manual sheet feeding tray of FIG. 12, viewed from a rear side thereof.
Figure 14:
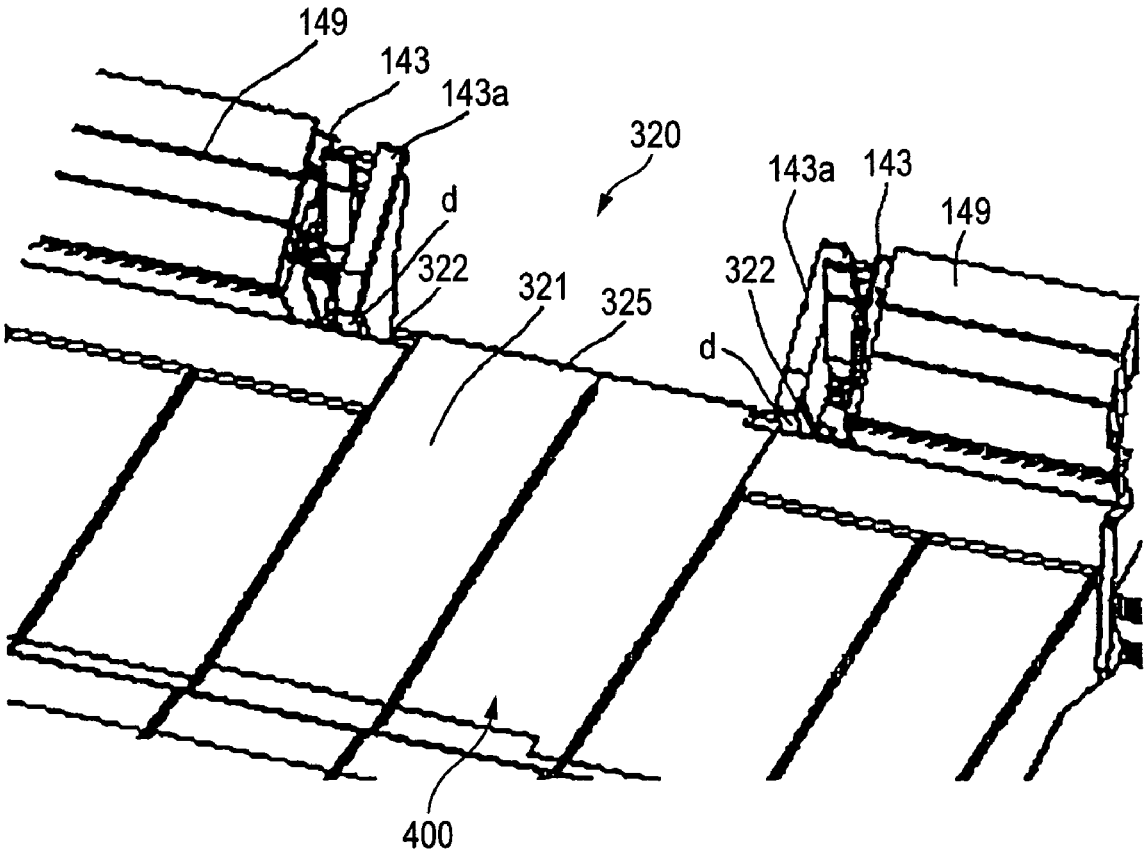
FIG. 14 is an enlarged perspective view of the manual sheet feeding tray of FIG. 12, showing a state that the sheet feeding roller is removed.

FIGS. 12 and 13 show a second embodiment of the invention. Components similar to those in the first embodiment will be designated by the same reference numerals and repetitive explanations for those will be omitted. In a manual sheet feeding tray 400 of this embodiment, a projected portion 325 is formed on a part of the rear edge 322 of the extensible portion 320. The reason for forming such a projected portion 325 is described hereinbelow by referring to the figures.

As described above, the manual sheet feeding tray 400 can be moved in the vertical direction by the hopper 141. It should be noted that a space "d" is provided between the rear edge 322 of the extensible portion 320 and each of paired sheet edge guides 143*a* so as to prevent the rear edge 322 of the extensible portion 320 from interfering with the sheet edge guides 143*a* formed integrally with the pad supports 143 when the manual sheet feeding tray 400 is moved.

Thus, when the cut sheet to be manually fed is set on the manual sheet feeding tray 400, a leading edge of the cut sheet may enter the space "d" and may be folded. This may preclude the manual feeding of the cut sheet. Thus, the projected portion 325 protruded from the rear edge 322 of the extensible portion 320 is formed integrally with the extensible portion 320 between the paired sheet edge guides 143*a* to partly overlap with the sheet edge guides 143*a*. Consequently, the leading edge of the cut sheet is prevented by the projected portion 325 from entering the space "d". Thus, the leading edge of the cut sheet can be prevented from being folded. Hence, the manual feeding of the cut sheet can surely be achieved.

Incidentally, as long as the projected portion 325 can overlap with the sheet edge guides 143*a* at least partly at the position at which the projected portion 325 is formed, the projected portion 325 may be formed at any position. Further, the projected portion 325 is not necessarily formed integrally with the extensible portion 320. The projected portion 325 may be formed separately from the extensible portion 320. Although the manual sheet feeding tray 400 is provided with the extensible portion 320 in this embodiment, it may be constituted by a single plate member as long as the space "d" is provided between the rear edge of such a single plate member and the sheet edge guides 143*a*.

The invention can be applied to recording apparatuses, for example, facsimile machines and copiers, as long as the recording apparatuses have the above medium feeding device. Apparatus, to which the invention can be applied, are not limited to the recording apparatuses. The invention can also be applied to liquid ejecting apparatuses configured to eject liquid, which corresponds to an intended purpose, instead of ink, from a liquid ejection head toward a target medium. For example, apparatuses respectively having a colorant ejection head used for manufacturing a color filter of a liquid crystal display, an electrode material (or electrically conductive paste) ejection head used for forming electrodes of an organic EL display or a field emission display (FED), a bioorganic material ejection head used for manufacturing a biochip, and a sample ejection head serving as a precision pipette.

What is claimed is:

1. A medium feeding device, adapted to be attached to a recording apparatus to feed a recording medium thereto or adapted to be attached to a liquid ejecting apparatus to feed a target medium thereto, comprising:

a feeding roller;

a first tray, provided with a hopper adapted to support the recording medium or the target medium which is to be automatically fed to the recording apparatus or the liquid ejecting apparatus by the feeding roller; and a second tray, arranged above the first tray and adapted to support the recording medium or the target medium which is to be manually fed to the recording apparatus or the liquid ejecting apparatus, the second tray comprising a tray body and an extensible member which is retractably extended from the tray body toward the feeding roller, wherein the hopper is operable to lift the tray body and the extensible member to bring the recording medium or the target medium placed thereon into contact with the feeding roller.

2. The medium feeding device as set forth in claim 1, wherein the tray body is provided with a lever mechanism operable to extend or retract the extensible member.

3. The medium feeding device as set forth in claim 2, wherein the lever mechanism includes a movable member which is placed in a lateral end portion of the tray body to guide a side edge of the recording medium or the target medium when the extensible member is extended, and is placed in such a position that an ingress of the recording medium or the target medium which is to be manually fed is prevented when the extensible member is retracted.

4. The medium feeding device as set forth in claim 3, wherein the lever mechanism includes a cam mechanism coupling the movable member and the extensible member.

5. The medium feeding device as set forth in claim 1, further comprising a pair of guide members adapted to guide a leading end of the recording medium or the target medium supported by the extendible member, wherein:

a gap is provided between a distal end of the extensible member and each of the guide members; and the distal end of the extensible member is formed with a portion projecting into a space defined between the guide members.

6. A recording apparatus comprising a recording head operable to record information on the recording medium fed by the medium feeding device as set forth in claim 1.

7. A liquid ejecting apparatus comprising a liquid ejecting head operable to eject a liquid droplet toward the target medium fed by the medium feeding device as set forth in claim 1.

8. The medium feeding device according to claim 1, further comprising:

a pair of guide members adapted to guide a leading end of the recording medium or the target medium supported by the second tray, wherein:

a gap is provided between an end of the second tray opposing to the feeding roller and each of the guide members; and the end of the second tray is formed with a portion projecting into a space defined between the guide members.

9. A recording apparatus comprising a recording head operable to record information on the recording medium fed by the medium feeding device as set forth in claim 8.

10. A liquid ejecting apparatus comprising a liquid ejecting head operable to eject a liquid droplet toward the target medium fed by the medium feeding device as set forth in claim 8.

11. The medium feeding device as set forth in claim 8, wherein the second tray is adapted to exclusively support the recording medium or the target medium which is to be manually fed to the recording apparatus or the liquid ejecting apparatus.

12. The medium feeding device as set forth in claim 1, wherein the hopper is operationally aligned with the first tray to transfer one of the recording medium or the target medium from the first tray to the feeder roller during an automatic feed operation.

13. The medium feeding device as set forth in claim 1, wherein the second tray is arranged above the hopper.

* * * * *